United States Patent [19]

Paxon

[11] Patent Number: 4,914,483

[45] Date of Patent: Apr. 3, 1990

[54] ELECTROSTATOGRAPHIC TRANSFER WITH ARTIFACT SUPPRESSION

[75] Inventor: James F. Paxon, Rochester, N.Y.

[73] Assignee: Eastman Kodak Company, Rochester, N.Y.

[21] Appl. No.: 338,812

[22] Filed: Apr. 17, 1989

[51] Int. Cl.[4] ..... G03G 21/00; G03G 15/14

[52] U.S. Cl. ..... 355/271; 355/308; 355/309; 355/312

[58] Field of Search ..... 355/312, 309, 308, 271, 355/277, 326, 327, 273, 208

[56] References Cited

U.S. PATENT DOCUMENTS

| | | | |
|---|---|---|---|
| 3,834,807 | 9/1974 | Fuller et al. | 355/271 X |
| 4,023,894 | 5/1977 | Goel | 355/312 |
| 4,080,053 | 3/1978 | Friday | 355/271 |
| 4,403,847 | 9/1983 | Chrestensen | 355/312 X |
| 4,745,489 | 5/1988 | Kashiwagi et al. | 355/271 X |

*Primary Examiner*—A. T. Grimley
*Assistant Examiner*—Matthew S. Smith
*Attorney, Agent, or Firm*—Milton S. Sales

[57] ABSTRACT

An electrostatographic reproduction apparatus includes an image member for bearing toned electrostatic images, and transfer apparatus having a transfer member for transferring toned images from the image member to a receiver sheet with a given transfer efficiency. The transfer member includes a plurality of vacuum vents for gripping a receiver sheet thereto such that the vents affect the transfer efficiency in the region of the toned images which align with the vents. Means are provided for adjusting the density of the toned image on the image member in the region of the vents such that the affect on the transfer efficiency by the vents is substantially offset by the adjustment to the density of the toned image. In a preferred embodiment, the transfer member is a drum.

9 Claims, 2 Drawing Sheets

ELECTROSTATOGRAPHIC TRANSFER WITH ARTIFACT SUPPRESSION

BACKGROUND OF THE INVENTION

1. Technical Field

This invention relates generally to electrostatography, and more specifically to copiers and printers having transfer apparatus for transferring electrostatically held toner images in registry to a receiver sheet.

2. Background Art

In a typical electrostatographic process for making reproductions, an electrostatic charge pattern having an image-wise configuration corresponding to information to be reproduced, is formed on the surface of a grounded image member. The charge pattern is developed by applying developer material to such pattern to form a transferable image on the image member. The developer material includes for example, thermoplastic pigmented marking particles which are attracted to the charge pattern by electrostatic forces. The transferable image is transferred from the image member to a receiver sheet, and permanently fixed to the sheet to form the reproduction. Transfer is accomplished by electrically charging the receiver sheet to a level sufficient to attract the developer material from the image member to the receiver sheet while the sheet is in contract with the area of the image member carrying the transferable image. Electrical charging of the receiver sheet is commonly effected by contacting the surface of the receiver sheet opposite the image member with an electrically biased transfer drum.

An electrically biased transfer drum is suitable for use in an electrostatographic process where multiple related images are transferred in superimposed relation onto a receiver sheet to form a composite reproduction, such as in making a multi-color reproduction. In such a process the receiver sheet is tacked to the transfer drum so that the sheet is successively returned into registered contact with the related transferable images on the image member. An example of such a transfer drum is shown in U.S. Pat. No. 4,712,906, which issued to R. M. Bothner et al. on Dec. 15, 1987.

Such drums often have a vacuum gripping mechanism for attaching the leading edge of a receiver sheet to the drum. However, toner transfer efficiency is generally poor in the region of each vacuum vent, causing an artifact in the transferred image in that region.

Some efforts have been made to reduce such artifacts in the transferred image. For example, commonly assigned U.S. Pat. No. 4,403,847, which issued to G. L. Chestensen on Sept. 13, 1983, discloses a re-transfer apparatus which includes a resilient, deformable electrically conductive drum cover connected to a source of electrical image transferring potential. The conductive drum cover defines a vacuum vent for tacking a receiver sheet. The vent has a longitudinal axis which, at the surface of conductive member, defines an oblique angle to the surface. During image transfer, the drum cover deforms under pressure to eliminate the surface discontinuity at the vent opening so that an electrical transfer potential is uniformly applied. However, the Chestensen system is mechanically complex, and it is not always desirable to use a resilient drum cover.

DISCLOSURE OF INVENTION

Accordingly, it is an object of the present invention to provide an improved transfer apparatus which can grip a receiver sheet without causing transfer artifacts in the gripping region.

It is another object of the present invention to provide an improved transfer apparatus which includes a transfer drum having vacuum vents for gripping a receiver sheet and means for reducing the artifacts caused by the vacuum vents.

According to one aspect of the invention, these objects are accomplished by providing means for increasing the latent image in the region of the gripping means to compensate for the reduced transfer efficiency thereat.

According to another aspect of the invention, these objects are accomplished in a non-impact dot printer by increasing the density signal to the print head in the region of the image member corresponding to the gripping means.

An electrostatographic reproduction apparatus includes an image member for bearing electrostatic member for transferring toned images from the image member to a receiver sheet with a given transfer efficiency. The transfer member including means for gripping a receiver sheet thereto such that the gripping means affects the transfer efficiency in the region of the toned images which align with said gripping means. Means are provided for adjusting the density of the toned image on the image member in said region such that the affect on the transfer efficiency by the gripping means is substantially offset by the adjustment to the density of the toned image. In a preferred embodiment, the transfer member is a drum and The gripping means is a plurality of vacuum vents in the drum.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

SPECIFIC DESCRIPTION OF THE INVENTION

Figure 1:
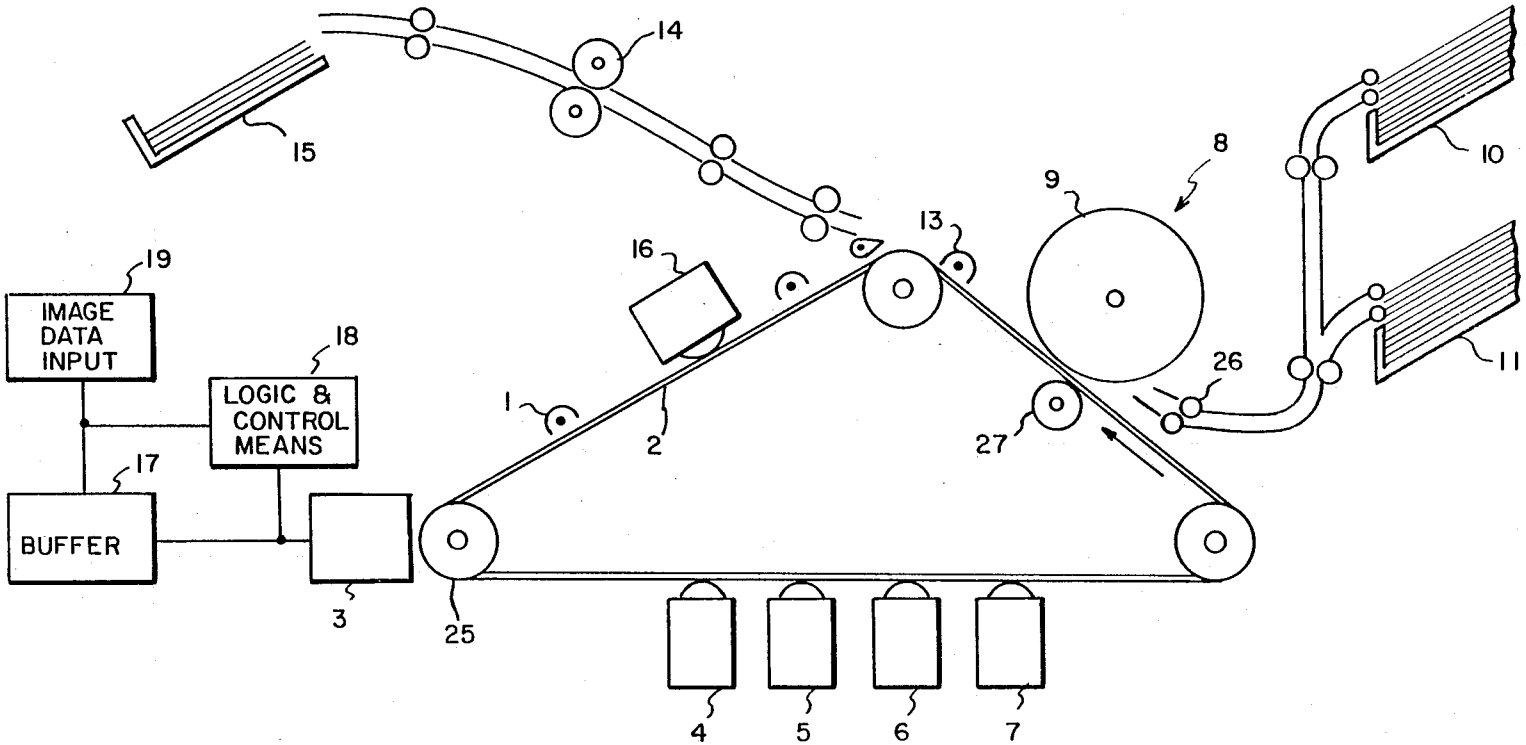
FIG. 1 is a schematic diagram of a multi-color electrostatographic reproduction apparatus incorporating the invention.

According to FIG. 1, electrostatographic reproduction apparatus, for example, a non-impact, electrophotographic printer, includes a charging mechanism 1 which places a uniform charge on an image member such as an endless photoconductive web 2. An electronic exposure station 3 imagewise exposes the charged image member 2 creating an electrostatic image which is toned by one of toner stations 4, 5, 6, and 7. The toned image is then transferred to a receiver sheet by a transfer apparatus 8. Transfer apparatus 8 includes a transfer member such as a drum 9, shown in more detail in the other figures and a backup drum 27 offset slightly upstream of drum 9 to create a low pressure nip. Transfer sheets are fed from copy stations 10 or 11 through a series of rollers and guides to the transfer apparatus 8. As controlled by intermittently driven rollers 26, the receiver sheets are driven into engagement with and secured to transfer drum 9, and multiple related toner images are transferred to the sheets in superimposed relation to form a reproduction. To assist in transfer, drum 9 is electrically biased by means (not shwon) well known in the art. Receiver sheets separate from the transfer drum 9 when the securing force is removed, and the receiver sheet is stripped from image member 2 at a separation station including a corona 13. The receiver sheets are transported by rollers and guides to a fuser 14 and then to a hopper 15. Image member 2 is cleaned for reuse at a cleaning station 16.

Although exposure station 3 is shown as an electronic exposure station it can also be an optical exposing station with minor variations in the schematic of FIG. 1. Typical electronic exposure stations can include, for example, laser scanning apparatus of an LED printhead, both structures are well known in the art.

Exposure station 3 responds to data fed from an image memory, such as for example buffer 17 which stores information representing images to be produced. The information stored in buffer 17 is received from an image data input 19 which can be a computer, a scanner, or the like. A logic and control means 18 controls the storage of the image data in the buffer and the submission of the image data, including the order of submission of the images, from the buffer to exposure station 3.

Figure 3:
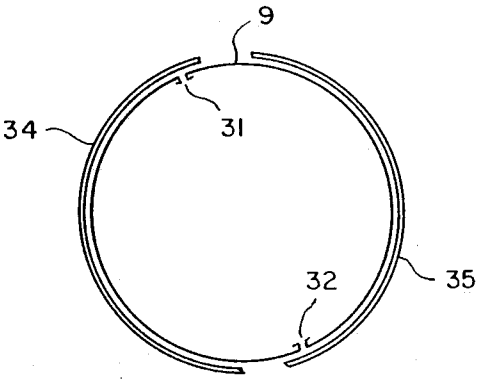
FIG. 3 PRIOR ART
FIG. 3 is a schematic end view of a transfer drum constructed according to the invention with two letter size receiver sheets attached thereto.
Figure 2:
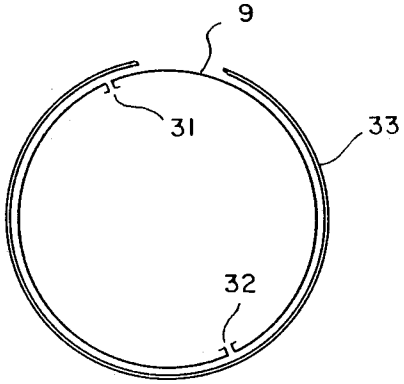
FIG. 2 PRIOR ART
FIG. 2 is a schematic end view of a transfer drum constructed according to the invention with a single ledger size receiver sheet attached thereto.

FIGS. 2 and 3 schematically illustrate aspects of the prior art. Transfer drum 9 is shown to have vacuum vents 31 and 32 separated by approximately 180 degrees. Vacuum vents 31 and 32 are actually a line of vacuum vents running the axial length of the drum to grip the leading edge of receiver sheets.

According to FIG. 2, a ledger size receiver sheet 33 is secured to drum 9 at its leading edge by use of vacuum vents 31. In FIG. 3, two letter size receiver sheets 34 and 35 have their leading edges secured by vents 31 and 32, respectively. Details can be read in above-mentioned U.S. Pat. No. 4,712,906.

In operation, logic and control means 18 programs exposure station 3 to expose image member 2 to create consecutive related images suitable for transfer to a single receiver sheet. For example, if a three-color image is to be produced, three images representing three different color components of a multi-color image, are produced on image member 2. One is toned with cyan, the second is toned with magenta, and the third is toned with yellow toner by developing stations 4, 5, and 6 respectively. As the first image approaches the transfer apparatus, a receiver sheet is fed from supply 10 or 11 into contact with drum 9 just prior to contact with the image by timing and registration means well known in the art. The leading edge of the sheet is gripped to the transfer drum by the vacuum produced through vents 31 or 32.

As the drum rotates, the receiver sheet rotates with it with the cyan toner image now transferred to the receiver sheet. As transfer drum 9 continues to rotate, the leading edge of the receiver sheet approaches the image member again and arrives in registry with the magenta image, which is now reaching the transfer station. The magenta image is then transferred to the receiver sheet in registration with the cyan image. The same is repeated for the yellow image, giving a transferred multicolor image according to the information supplied to exposure station 3.

After the leading edge of the copy sheet enters the nip to receive the yellow, third, image the vacuum through vent 31 is relieved and the receiver sheet then separates from drum 9 to follow image member 2. It is then stripped from the image member at the separation station and fed is to fuser 14 and hopper 15, all as is well known in the art. Also as is well known in the art, the receiver sheet can be recirculated to receive one or more images on its reverse side by a suitable mechanism, not shown.

Exposure station 3 places electrostatic images on image member 2 such that vacuum vents 31 and 32 will always align with the same regions of the toned images. Logic and control means 18 is programmed to add a predetermined density to the image in the regions of the vacuum vents to compensate for the lesser transfer efficiency at the vents.

Exposure station 3 may be either single bit per pixel (adapted to produce dots of a constant density) or multiple bit per pixel (adapted to produce grey level dots). Both types of exposure stations are well known, and are suitable for use with the present invention.

In single bit per pixel apparatus, the illusion of different grey scale images can be obtained by means of conventional processes for reproducing picture signal levels using halftones, such as for example the dither method, the area gradation method, etc. In each of these methods, several pixels are grouped to form a "superpixel" unit for expressing a half-tone density. Halftone density level is a function of the present dot which fills in the area of the superpixel unit. According to the present invention, the halftone density levels in regions of the images which align with the vacuum vents are increased so that a denser toned image is produced on image member 2. For example, a density of, say, 0.6 may normally require a 50% dot. However, in the region of image member 2 that always overlies vacuum vents 31 or 32, a 0.6 density would be written by, say, a 60% dot rather than a 50% dot so that the finished image comes out at 0.6 density due to the reduced transfer efficiency in the region of the vacuum vent. When the image is transferred, the reduced transfer efficiency at the vents will result in the proper density on the receiver sheet.

In multi bit per pixel reproduction apparatus, grey scale is obtained by changing the density of each pixel in accordance with a mutli-bit word stored in a bit may at an address corresponding to that particular pixel. Often, such apparatus does not have sufficient grey scale levels to produce the desired range of densities, and a combination of multi bit and single bit recording is used. According to this invention, the words stored in the bit map addresses corresponding to the regions of the vacuum vents are changed so that a denser toned image is produced on image member 2. When the image is transferred, the reduced transfer efficiency at the vents will result in the proper density on the receiver sheet.

Adjustment of the exposure level can be done in software or hardware, such as by table lookup. Each density level input will have a corresponding enhanced density level output which will result in the proper transferred density. Since transfer is also influenced by other factors, such as charge to mass ratio, relative humidity, dwell time, etc., a single software adjustment of look up table used with, say, one relative humidity to change the density in the regions on the vents might not be correct at another relative humidity. Therefore, a plurality of software adjustments or tables would be preferred. This plurality can be automatically or operator selected.

The invention has been described in detail with particular reference to preferred embodiments thereof, but it will be understood that variations and modifications can be effected within the spirit and scope of the invention.

What is claimed is:

1. An electrostatographic reproduction apparatus comprising:

an image member for bearing toned electrostatic images;

transfer apparatus having a transfer member for transferring toned images from the image member to a receiver sheet with a given transfer efficiency, said transfer member including means for gripping a receiver sheet thereto such that the gripping means affects the transfer efficiency in the region of the toned images which align with said gripping means; and means for adjusting the density of the toned image on the image member in said region such that the affect on the transfer efficiency by the gripping means is substantially offset by the adjustment to the density of the toned image.

2. An electrostatographic reproduction apparatus as defined in claim 1 wherein:

said transfer member is a drum; and said gripping means is a plurality of vacuum vents in the drum.

3. An electrostatographic reproduction apparatus comprising:

an image member for bearing toned electrostatic images;

transfer apparatus having a transfer member for transferring toned images from the image member to a receiver sheet with a given transfer efficiency, said transfer member including means for gripping a receiver sheet thereto such that the gripping means negatively affects the transfer efficiency in the region of the toned images which align with said gripping means; and means for increasing the density of the toned image on the image member in said region such that the negative affect on the transfer efficiency by the gripping means is substantially offset by the increase in the density of the toned image.

4. An electrostatographic reproduction apparatus comprising:

an image member for bearing toned electrostatic images;

transfer apparatus having a transfer member for transferring a plurality of related toned images in superimposed relation from the image member to a receiver sheet with a given transfer efficiency to form a composite reproduction, said transfer member including means for gripping a receiver sheet thereto such that the gripping means affects the transfer efficiency in the region of the toned images which align with said gripping means; and means for adjusting the density of the toned images on the image member said region such that the affect on the transfer efficiency by the gripping means is substantially offset by the adjustment to the density of the toned images.

5. An electrostatographic reproduction apparatus and defined in claim 4 wherein said plurality of related toned images are of different colors.

6. An electrostatographic reproduction apparatus comprising:

an image member;

a dot matrix print head for producing an electrostatic charge dot pattern on an image member;

a development station for applying toner to the electrostatic charge dot pattern to form a transferable toner image;

transfer apparatus having a transfer member for transferring toned images from the image member to a receiver sheet with a given transfer efficiency, said transfer member including means for gripping a receiver sheet thereto such that the gripping means affects the transfer efficiency in the region of the toned images which align with said gripping means; and means for adjusting the electrostatic charge dot pattern on the image member in the region of the image member which aligns with the gripping means such that the affect on the transfer efficiency by the gripping means is substantially offset by the adjustment to the electrostatic charge dot pattern.

7. An electrostatographic reproduction apparatus comprising:

an image member;

a dot matrix print head for producing an electrostatic charge dot pattern on an image member;

a development station for applying toner to the electrostatic charge dot pattern to form a transferable toner image;

transfer apparatus having a transfer member for transferring toned images from the image member to a receiver sheet with a given transfer efficiency, said transfer member including means for gripping a receiver sheet thereto such that the gripping means negatively affects the transfer efficiency in the region of the toned images which align with said gripping means; and means for increasing the electrostatic charge dot pattern on the image member in the region of the image member which aligns with the gripping means such that the affect on the transfer efficiency by the gripping means is substantially offset by the increase in the electrostatic charge dot pattern.

8. An electrostatographic reproduction apparatus comprising:

an image member;

means for producing a single bit per pixel electrostatic charge dot pattern on the image member for reproducing picture signal levels using halftones by grouping several dots to form a superpixel such that halftone density level is a function of the percent dot which fills the area of the superpixel;

a development station for applying toner to the electrostatic charge dot pattern to form a transferable toner image;

transfer apparatus having a transfer member for transferring toned images from the image member to a receiver sheet with a given transfer efficiency, said transfer member including means for gripping a receiver sheet thereto such that the gripping means affects the transfer efficiency in the region of the toned images which align with said gripping means; and means for adjusting the percentage dot in the region of the image member which aligns with the gripping means such that the affect on the transfer efficiency by the gripping means is substantially offset by the adjustment to the percentage dot.

9. An electrostatographic reproduction apparatus comprising:

an image member;

means for producing a multiple bit per pixel electrostatic charge dot pattern on an image member by changing the density of each pixel in accordance with a multi-bit word corresponding to the pixel;

a development station for applying toner to the electrostatic charge dot pattern to form a transferable toner image;

transfer apparatus having a transfer member for transferring toned images from the image member to a receiver sheet with a given transfer efficiency, said transfer member including means for gripping a receiver sheet thereto such that the gripping means affects the transfer efficiency in the region of the toned images which align with said gripping means; and means for adjusting the multi-bit word corresponding to each pixel on the image member in the region of the image member which aligns with the gripping means such that the affect on the transfer efficiency by the gripping means is substantially offset by the adjustment to the multi-bit word.

* * * * *